United States Patent [19]

Ranhagen

[11] Patent Number: 4,560,439

[45] Date of Patent: Dec. 24, 1985

[54] METHOD AND GRINDER FOR THE MANUFACTURE OF PULP

[76] Inventor: Ernst G. Ranhagen, Meteorvägen 60, Täby, Sweden

[21] Appl. No.: 413,370

[22] PCT Filed: Dec. 22, 1981

[86] PCT No.: PCT/SE81/00391

§ 371 Date: Aug. 13, 1982

§ 102(e) Date: Aug. 13, 1982

[87] PCT Pub. No.: WO82/02219

PCT Pub. Date: Jul. 8, 1982

[30] Foreign Application Priority Data

Dec. 23, 1980 [SE] Sweden ..... 8009096

[51] Int. Cl.[4] ..... D21B 1/14

[52] U.S. Cl. ..... 162/261; 241/244; 241/261.1

[58] Field of Search ..... 162/23–28, 162/18, 52, 261; 241/18, 21, 28, 244, 261.1

[56] References Cited

U.S. PATENT DOCUMENTS

| | | | |
|---|---|---|---|
| 2,943,012 | 6/1960 | Dunning et al. | 162/23 |
| 4,247,363 | 1/1981 | Soma et al. | 162/28 |
| 4,283,016 | 8/1981 | Reinhall | 241/28 |
| 4,456,503 | 6/1984 | Bystedt | 162/261 |
| 4,457,804 | 7/1984 | Reinhall | 162/241 |

FOREIGN PATENT DOCUMENTS

| | | | |
|---|---|---|---|
| 485228 | 7/1952 | Canada | 241/244 |
| 7900789 | 10/1979 | PCT Int'l. Pat. Appl. | 241/244 |

*Primary Examiner*—Peter Chin

*Attorney, Agent, or Firm*—Eric Y. Munson

[57] ABSTRACT

Method and grinder for the manufacture of fibre pulp from lignocellulosic material, such as wood chips or the like. The fibres are detached from the material by means of a grinding member (6) and the fibrous material is formed into a body, which without rotational movement is fed, while being compressed, into a grinding zone (5) which has converging wall surfaces. In the grinding zone (5) the fibrous material is worked upon by the grinding member (6) which is rotatable relatively to the body of fibrous material and which delimits at least one of the converging wall surfaces of the grinding zone (5). The detached fibres are removed (at 8) from the grinding zone.

2 Claims, 7 Drawing Figures

10
9
8
III
III
6
5
7
4
2
1
II
II
3
1
4
2
7
9
8
6

METHOD AND GRINDER FOR THE MANUFACTURE OF PULP

The present invention relates to an apparatus for use in the manufacture of pulp from lignocellulosic material, such as wood chips or the like, the fibres being detached from the material by means of grinding tools or members.

Mechanical pulp is manufactured since long ago from round timber in grinders and from wood chips in disc-crushers, so-called refiners. During the last decade the refiner method has been developed so that it now is possible to manufacture a stronger pulp than that which is obtained in conventional grinding mills. However, the refiner method requires about 50% more energy than the grinding mill method. Due to the increased energy costs, the interest has anew become directed towards the grinding mill method. Thus, in Swedish patent application No. 7900988-2 there is described a grinding mill which is operated under pressure, whereby a pulp is obtained which is equally as strong as refiner pulp, but with an energy consumption as in conventional grinding mills. However, grinding mills operated under pressure are expensive to be made and require high-priced round timber. A method to use wood chips as starting material in grinding mills is taught also in Swedish patent application No. 7810749-7. According to all methods now in use the produced grist requires extensive subsequent treatment such as screening and milling, which operations are expensive both with regard to investment costs and energy consumption. Known grinders are imperfect in their most important portion, the grinding zone, due to insufficient control possibilities with regard to maintenance of the temperature in the grinding zone, supply of liquid to the grinding zone, the pressure in the grinding zone, removal of released fibres, formation of sticks and shives, and orientation of the wood. Regarding the orientation of the wood it has been established both by experiments and practical experience that the consumption of power for manufacture of mechanical wood pulp is at its minimum when the wood is orientated in the plane of the grinding tool and with the grain transverse to the direction of movement of the surface.

The main object of the invention is to reduce the drawbacks inherent to today's grinding apparatus and refiners and to control temperature, pressure, liquid supply and liquid removal. In addition, in the grinding zone the invention renders possible optimal orientation of the wood in the grinding zone, elimination of formation of sticks and shives, reduction of wear of the grinding members, reduction of energy consumption and improvement of the brightness and bonding properties of the ground pulp.

This and other objects of the invention are achieved by imparting to the invention the characteristic features set forth in the subsequent claims.

The invention will hereinafter be described in more detail in conjunction with embodiments illustrated in the attached drawings.

Figure 4:
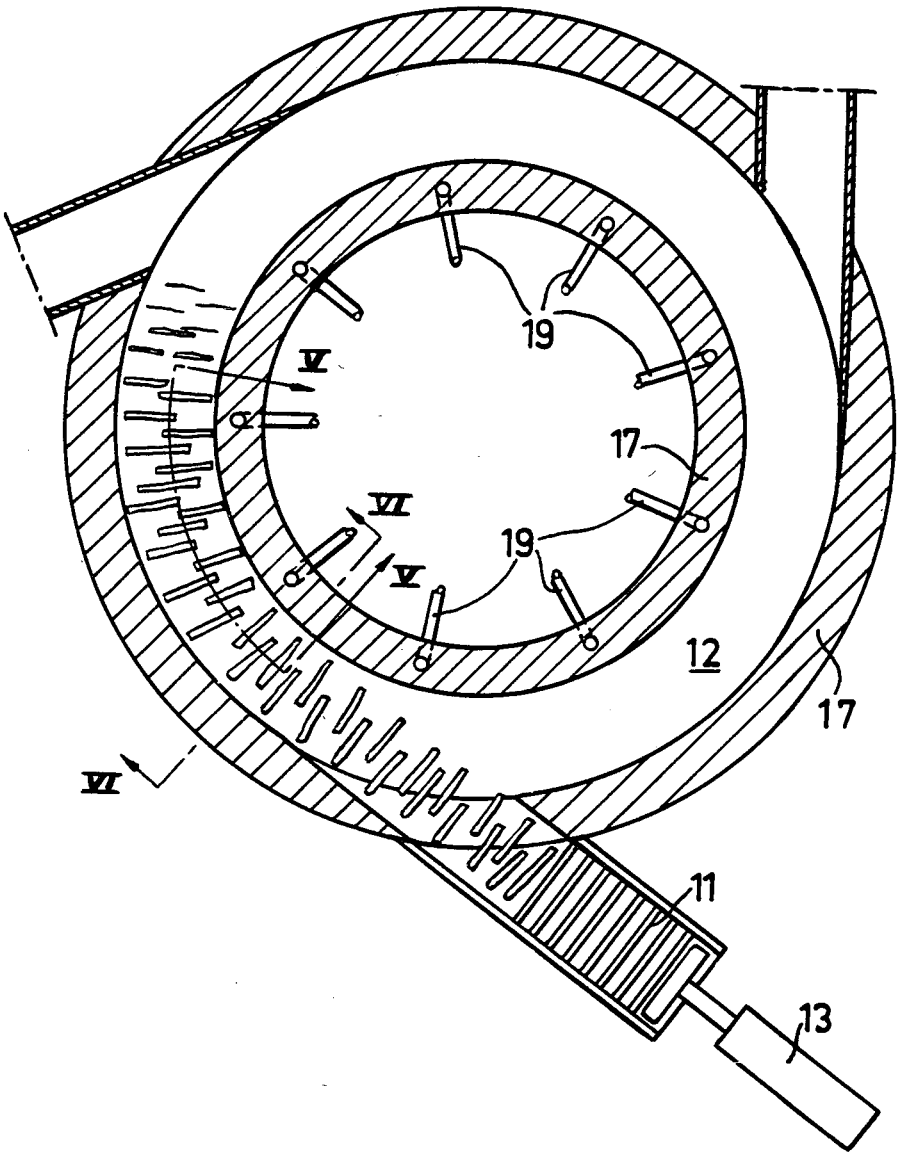
FIG. 4 shows a top plan view from a section taken along the line IV—IV in FIG. 5 of another embodiment of a grinder according to the invention.
Figure 5:
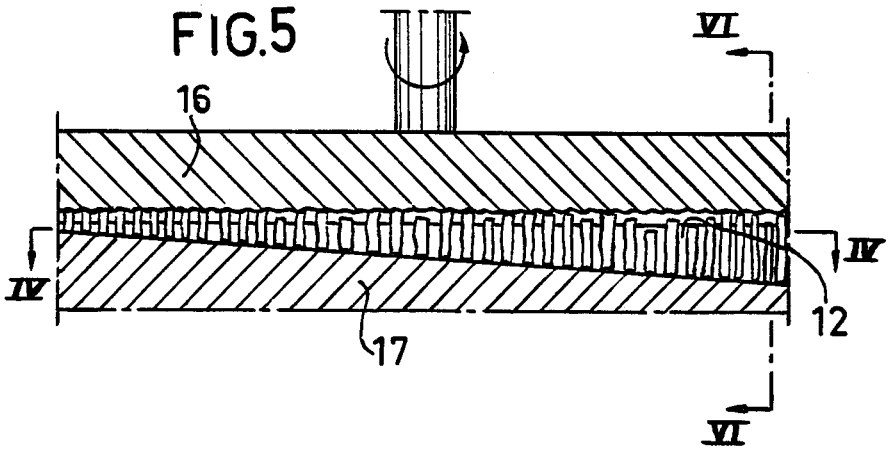
FIG. 5 shows a section along the line V—V in FIG. 4.
Figure 6:
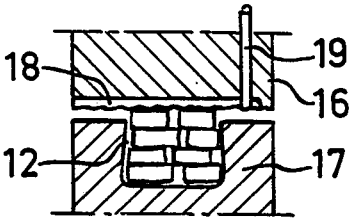
Figure 6A:
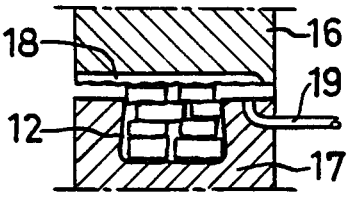

FIGS. 6 and 6*a* show sections along the line VI—VI in the FIGS. 4 and 5, respectively, of two different embodiments.

Figures 1, 2, 3:
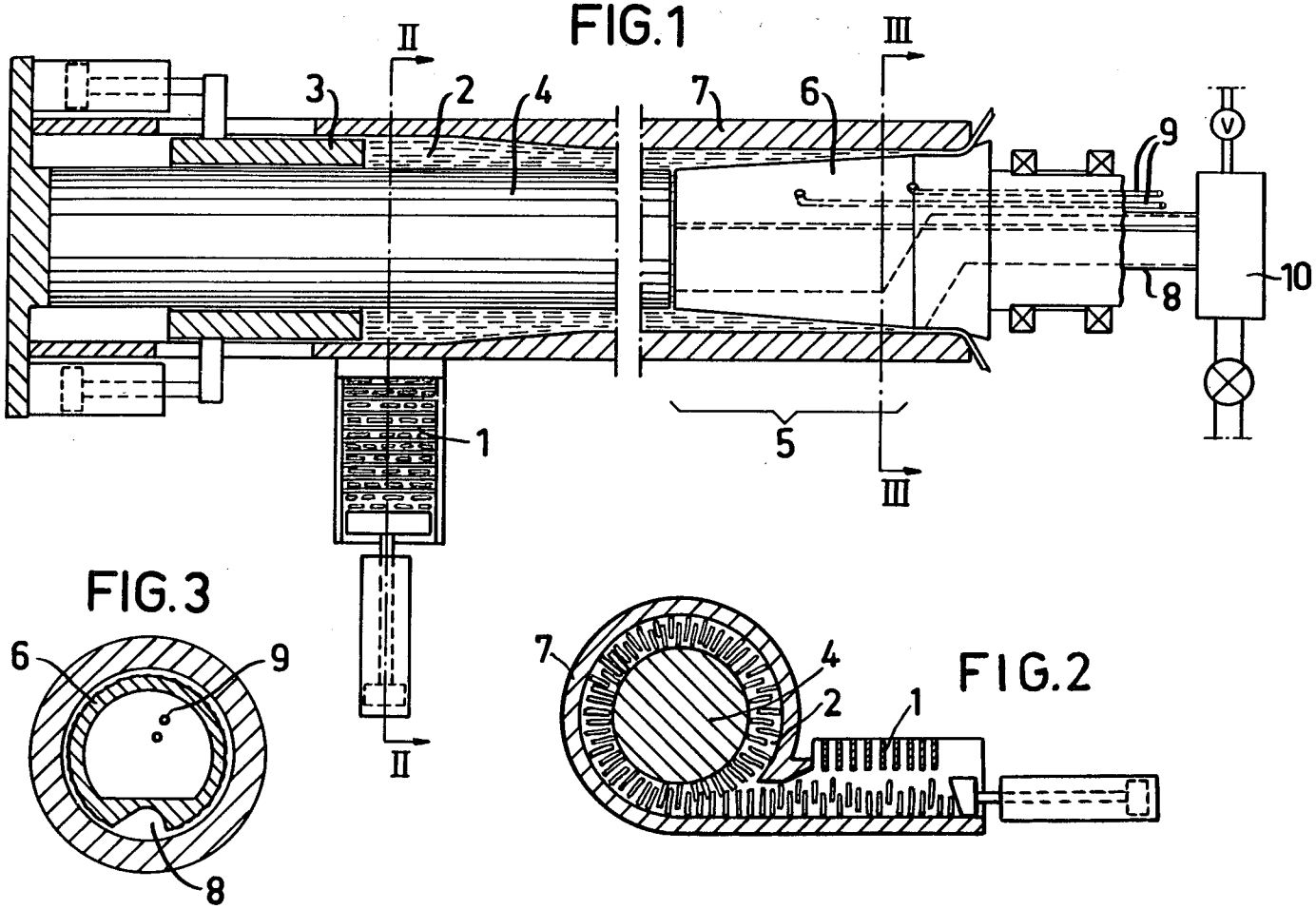
FIG. 1 shows a longitudinal section through a grinder for implementation according to the method of the invention.
FIG. 2 shows a section along the line II—II in FIG. 1.
FIG. 3 shows a section along the line III—III in FIG. 1.

In the embodiment shown in FIG. 1 of a grinder for implementation of the method according to the invention, wood chips are fed into the grinder by means of a slotted sieve plate 1, which is used for orienting the wood chips in a predetermined direction. It is advantageous to use relatively long chips. The chips orientated in this way enter now a space or chamber 2 which is formed between a core 4 stationarily mounted in the grinder and an outer tube or casing 7. The oriented and loosely packed chips in the chamber are thereafter fed by means of a reciprocating piston device 3 to the right in FIG. 1 towards a tapered portion of the chamber 2, within which portion the wood chips are compressed against the stationary core 4 and form a continuous cylindrical or tubular body of chips on the stationary core 4. Annexed to the right end, according the figure, of the core 4 is a rotatable grinding member 6, the diameter of which increases conically in the direction towards the right-hand end or the casing 7. In this way, a converging grinding zone 5 is formed, which zone is confined by the inner wall surface of the casing 7 and the outer circumference of the grinding member 6. Obviously, the converging grinding zone 5 can be formed also by the walls of the casing 7 having decreasing inner diameter and the grinding member 6 being cylindrical, or by both the casing 7 and the grinding member 6 having conical surfaces.

The casing 7 must have a length permitting formation of a plug having sufficient length so as not to be forced back by the steam pressure generated within the grinding zone. The plug is retained in the grinding zone 5 by friction against the wall of the casing 7. The grinding member 6 may be manufactured as a tubular body and its grinding surface may be formed directly on the member or by conventional grinding segments rigidly secured onto the grinding member.

The initially compressed body or plug of chips is further compressed during its continued advancement in the grinding zone 5 along the surface of the rotating grinding member 6 and forms in the grinding zone 5 a compressed plug which is stationary and from which the fibres are separated by the grinding member 6. This plug is forced into contact with the grinding member by the pressure from the piston device 3. The grinding member 6 has a surface with projections, preferably in a pattern which produces pressure impacts causing the plug of chips to be worked internally during its advance within the converging grinding zone 5. The pattern on the surface may be coherent or consist of separate punctiform "burls". In either case the pattern may have spiral shape with positive or negative course, ie to the left or to the right in the figure, even a sine-shaped spiral form. However, it may also extend in parallel to the axis. The projections of the pattern may also have a recess or "cavity" at the top. In a punctiform pattern the projections should overlap each other seen in the direction of movement of the grinding member. The pattern may also have projections resembling sawteeth, at least one of the edges being curved or rounded and the pattern being arranged so that the rounded edge is turned into the direction of movement (direction of rotation) of the grinding member. The projections should have a height up to 1.2 mm, preferably between 0.03 and 1.0 mm.

The grinding member may be of a material which has pores in the surface, i.e. is permeable to water, which permits penetration downwards into the surface of the grinding member, so that a thin layer of water is formed adjacent said surface. This layer of water creates a hydraulic pressure which prevents the grinding member from coming into direct contact with the fibrous material, and forms a thin water layer which transmits the pulsations from the surface pattern to the fibrous material. The thin water layer also is effective to keep the surface of the grinding member free from material which otherwise could stick to the surface. The grinding member or its grinding segments are preferably made of cemented pulverulent material of steel, hard metal or the like or granules of ceramic material which are compressed and joined together in a manner known in this specific art.

Through channels 9 in the grinding member 6 liquid, such as water, but also chemicals, alkali or the like, is supplied at desired places distributed over the grindng zone 5. The discharged fibres are carried away by the added liquid via one or several channels 8 in the grinding member 6. Said grinding member 6, which in the embodiment illustrated in FIG. 1 is conical, has its greatest diameter adjacent the inner diameter of casing 7 at the right-hand discharge end thereof. Thus the wood residues form a seal against the grinding zone 5, when they pass through the gap defined between said casing and the grinding member 6. These wood residues can be taken care of and returned to the incoming chip material. The grinding operation in the grinding zone 5 can also be performed under pressure above atmospheric (steam pressure) which is built up by generating a counter-pressure in the outlet channel 8, the body of chips precompressed in the chamber 2 forming a plug which seals against the inlet 1 for the chips from the feeding device 1. Obviously, a sluicing device can be used also for feeding the chips into the chamber 2 and/or discharging the grist from the outlet channel 8. In this latter case the grist passes from the channel 8 into a vessel 10, wherein the grist and the steam are separated from each other and in pressure-tight manner led away from the vessel.

In the embodiment shown in FIGS. 4 to 6 of the grinder according to the invention, corresponding details of the grinder have been given the same reference numerals as in the embodiment of FIG. 1 with the digit 1 added ahead of said reference numeral. Thus, the grinding member shown in FIGS. 4 to 6*a* of the consists of a disc 16 which rotates towards the feed chamber 12 in the casing or housing 17. The chips are fed from the slotted sieve plate 11 by means of a piston device 13 into the chips chamber 12. The chips bits are oriented with the grain radially in the plane of the disc 16 so that the grinding surface of the grinding member or grinding disc 16 is moved transversally to the fibre grain. The converging grinding zone is formed by the bottom of the chips chamber 12 having upward slope in the direction of feed, whereby the chips are forced by the piston device 13 into contact with the grinding disc 16. Water is added to the grinding zone through water inlets 19 provided either in the disc 16, see FIG. 6, the water then suitably being supplied through a bore in the shaft or, as an alternative, in the casing 17, as illustrated in FIG. 6*a*. Discharged fibres and water are drawn off through grooves 18 in the disc 16 adjacent the outer wall of the casing 17.

The grinding operation may be effected under superatmospheric pressure by the whole grinding mill being enclosed in a pressurized housing. The wood chips are sluiced into the housing by the piston device 13 whereby they become compressed into a continuous, sealing plug of chips. In order to attain uniform load around the grinding disc 16, the chips suitably are fed in at several places into the chips chamber 12, e.g. at three places as is shown in the embodiment of FIG. 4.

Obviously, the shown embodiments can be varied within the scope of the invention. Thus, the feeding devices, for example, may in known manner be devised as continuous one, such as screw feeders. The invention may also be applied to the grinding of round timber, in which case the core 4 in the centre is dispensed with and the grinding member 6 is formed as a cone.

Experiments show that the invention can be utilized for manufacturing a brighter pulp having improved bonding properties over pulp manufactured by known methods and, additionally, with low energy consumption. The probable explanation is that the wood in the grinding zone is compressed by the rotating member both axially and radially and forced into contact with the casing. The member produces vibrations which by the thin layer of water are transmitted to the wood, whereby fibres are released.

Owing to the defined processing in the grinding zone, a pulp can be manufactured with very low coarse fraction, which is important for the printability of paper made from said pulp.

The invention has the following advantages over previously known grinders and refiners:

1. The grinding zone is stuffed with compressed and orientated wood. Therefore, energy can be transferred from the grinding member to the wood without appreciable shock losses, without air admission and without excess of water.
2. Each wood element is subjected to a defined processing, ie every surface element of the wood in the grinding zone receives at a definite grinding pressure a predetermined number of pressure shocks from the grinding member, which has a settled pattern and is homogenuous, whereby a pulp practically free from shives is obtained. Usual nonhomogenous grindstones with their grains of various sizes mixed at random produce in the same manner as refiner discs varying frequencies which counteract each other. In known grinders and refiners, the wood is subjected to highly varying surface loading in contrast to the present invention.
3. The pattern of the grinding member transfers vibrations to the wood material via a thin layer of water, for which reason the friction is low and, therefore, the wear of the member slight. In known refiners the wear is great because of the direct contact between grinding disc and wood. The costs for replacement of grinding discs is a great item of expenditure for refiners.
4. The grinding is effected almost perpendicularly to the grain, which results in minimized energy consumption. In known refiners the treatment is at random with respect to the grain and, therefore, unfavourable.
5. Detached fibres leave the grinding zone quickly via a channel in the grinding member due to the fact that the grinding zone is relatively small. In known grinders and refiners, the fibres have to pass through a larger grinding zone and are subjected there to an uncontrolled treatment.

6. The grinding operation is effected in the absence of air, which prevents the pulp from oxidization.

7. The grinding is made in a sealed room where the grinding pressure can be adjusted, whereby the pulp quality can be acted upon.

The term "grinding" in the preceding description is primarily understood to define all kinds of treatment of the fibrous material where the fibres are torn off from the material by means of pressure shocks from the patterned surface of the grinding member.

I claim:

1. Apparatus for grinding lignocellulosic pulp material in chip form, comprising:

(a) a hollow cylinder defining a grinding zone in one end thereof and a feeding zone in the other end thereof, in which the pulp material is advanced into said grinding zone;

(b) a stationary core extending axially through said feeding zone and defining a tubular chip-advancement chamber between the exterior surface of said core and the interior surface of said cylinder;

(c) means for feeding the pulp material into said tubular chip-advancement chamber;

(d) means within said cylinder for advancing said pulp material in said tubular chip-advancement chamber towards said grinding zone;

(e) said tubular chip-advancement chamber converging towards said grinding zone to compress said pulp material during its advancement through said tubular chip-advancement chamber;

(f) a rotating grinding member extending axially through said grinding zone and being aligned with and facing the opposing end of said core;

(g) the exterior surface of said grinding member and the facing interior surface of said cylinder defining therebetween an annular grinding space aligned with said tubular chip-advancement chamber and converging outwardly to form a narrowed outlet gap for the ground material; and (h) means for discharging the ground material from said grinding zone.

2. Apparatus according to claim 1, including means for passing a treating agent into said grinding space.

* * * * *